US005590780A

United States Patent [19]

O'Meara

[11] Patent Number: 5,590,780

[45] Date of Patent: Jan. 7, 1997

[54] UNIT DOSE ASSEMBLY

[75] Inventor: John R. O'Meara, North Palm Beach, Fla.

[73] Assignee: Wheaton Holding, Inc., Wilmington, Del.

[21] Appl. No.: 493,790

[22] Filed: Jun. 22, 1995

[51] Int. Cl.[6] ..... B65D 21/00

[52] U.S. Cl. ..... 206/520; 215/48; 215/228; 220/278; 222/83; 222/107; 222/541.2

[58] Field of Search ..... 215/48, 228, 250; 206/505, 508, 509, 519, 520; 220/4.26, 4.27, 212, 278; 222/83, 107, 541.2

[56] References Cited

U.S. PATENT DOCUMENTS 5,024,354 6/1991 Ledewitz ..... 222/94
5,042,690 8/1991 O'Meara ..... 222/83
5,052,589 10/1991 O'Meara ..... 222/83
5,301,837 4/1994 O'Meara ..... 222/83

*Primary Examiner*—Stephen Cronin
*Attorney, Agent, or Firm*—Eugene E. Renz, Jr.

[57] ABSTRACT

An assembly comprising a container having a body portion and a nozzle at one end of reduced cross-section, a closure cap engagable over the nozzle portion, at least one internal rib in the container adjacent the juncture of the body portion and nozzle extending downwardly into the body portion a predetermined depth whereby when container and cap are nested, and the cap portion of a first container cap assembly engages interiorly the body portion to a point where it abuts the ribs, there is defined a gap of predetermined axial distance between the lower edge of the body portion of the first container cap assembly and the transition shoulder between the body portion and nozzle of a second container cap assembly.

5 Claims, 2 Drawing Sheets

UNIT DOSE ASSEMBLY

FIELD OF THE INVENTION

The present invention relates to improvements in unit dose assemblies and more specifically the invention relates to facilitating stacking and nesting of assemblies of this type so that they can be handled more readily in automatic filling and packing systems.

BACKGROUND OF THE INVENTION

Unit dose assemblies of this general type are not new per se. Unit dose assemblies of the general type to which the present invention relate are shown in my prior patents listed below:

U.S. Pat. No. 5,052,589

U.S. Pat. No. 5,042,690

SUMMARY OF THE INVENTION

The present invention provides an improvement in unit dose assemblies which facilitates handling of the assemblies by automated equipment to fill and seal the unit dose assemblies at high speed. More specifically, the automated process includes an infeed station wherein the unit dose assemblies to be filled and sealed are nested one inside the other in a compact array. The present invention provides a predetermined controlled spacing between the nested assemblies to define a gap between adjacent assemblies for separating one assembly at a time at the discharge end of the infeed station. The present invention insures trouble free feeding of discrete assemblies one at a time through the filling and sealing stations of the automated equipment. In the past, it has been found that misfeeds cause jam ups in the automated equipment and delay in the filling and sealing process. The present invention also insures compact stacking of the assemblies at the infeed station and does it in a matter insuring separation of the various assemblies easily and quickly. In other words, the present invention provides for friction free nesting of the assemblies providing a controlled gap between adjacent assemblies which aligns the gap to be engagable by the discharge mechanism which is timed and sequenced to feed one assembly at time form the infeed station to the other stations of the automated equipment.

BRIEF DESCRIPTION OF THE DRAWINGS

These and other objects of the present invention and the various features and details of the operation and construction thereof, are hereinafter more fully set forth with reference to the accompanying drawings, wherein.

DETAILED DESCRIPTION OF THE PREFERRED EMBODIMENT

Figure 2:
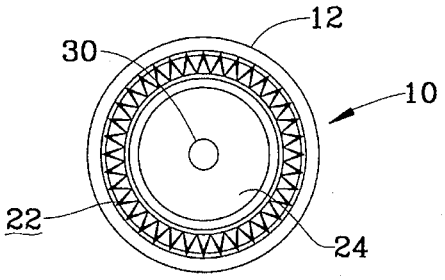
FIG. 2 is a plan view of the unit dose assembly shown in FIG. 1.
Figure 1:
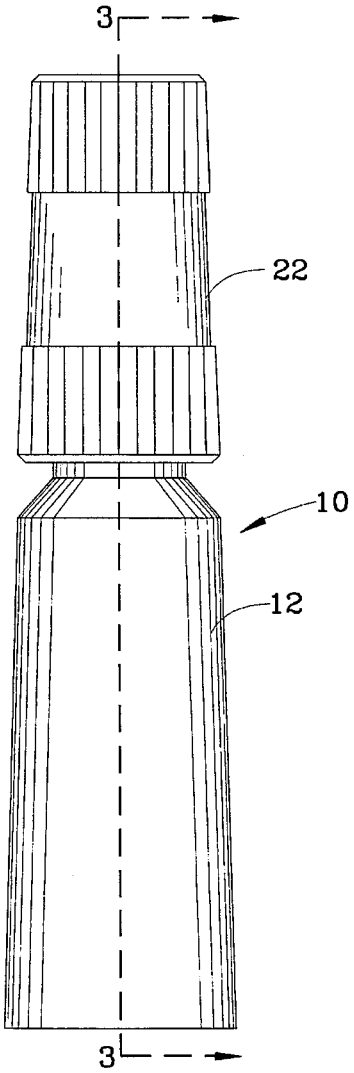
FIG. 1 is an enlarged side elevational view of a single untilled unit dose tube and cap assembly embodying the present invention.
Figure 3:
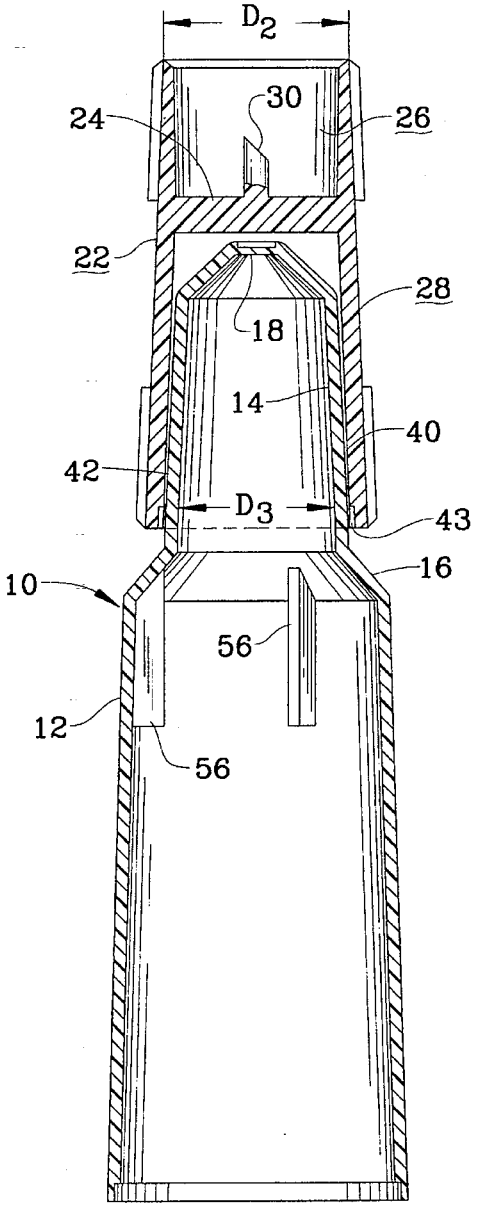
FIG. 3 is an enlarged sectional view taken on line 3—3 of FIG. 1.
Figure 4:
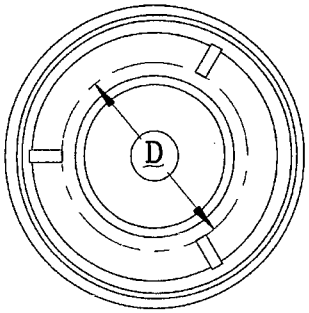
FIG. 4 is a bottom plan view of FIG. 3 showing the stacking lugs.
Figure 6:
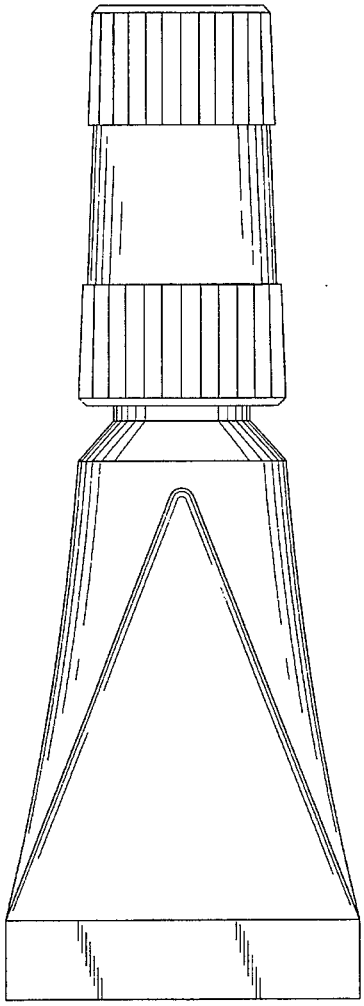
FIG. 6 is a side elevational view similar to FIG. 1 showing a filled and sealed unit dose cap container assembly.

Referring now to the drawings and particularly to FIGS. 1–3 thereof, there is shown a unit dose assembly generally designated by the numeral (10) incorporating means for controlled nesting of a plurality of assemblies in accordance with present invention. The unit dose assembly (10) basicly comprises a container or tube (12) having a nozzle (14) at its upper end of a reduced cross-sectional diameter connected to the tube (12) by a stepped frusto conical connecting wall (16). The upper axial end of the nozzle (14) has a generally circular area of reduced cross-section defining a piercable diaphragm (18). The lower end of tube (12) is open to facilitate filling of the robe in an inverted position. After filling, the lower terminal edge at the lower end of the tube is heat sealed to contain the contents as shown in FIG. 6.

The assembly further includes a cap (22) of generally cylindrical tubular shape having a transverse wall (24) dividing the cap into a piercing portion (26) and a sealing portion (28). A piercing element (30) projects from the wall (24). The sealing portion and nozzle have interengaging rib and groove means for supporting the cap on the tube in the manner shown in FIG. 3 before use. In the present instance, tube (14) has an exterior circumferentially extending rib (40) and the sealing portion of the cap has a complementary circumferentially extending groove (42). The inner wall of the sealing portion tapers outwardly as at (43) from the groove (42), to facilitate initial application of the cap to the nozzle as shown in FIG. 3. The piercing and sealing portions (26) and (28) have externally knurled surfaces to facilitate gripping of the cap by the user.

When the user wants to access the contents of the tube, the cap (22) is simply pulled axially upwardly, the rib (40) releasing the cap from the tube. The cap (22) is inverted to position the piercing portion over the outer axial end of the tube. With the piercing element (30) aligned with the diaphragm (18) as the cap is moved axially inwardly, the diaphragm (18) is pierced. The cap (22) is then removed and the contents can then be withdrawn. If all of the contents are not used, the cap can be again reversed to seal the tube for storage purposes.

Figure 5:
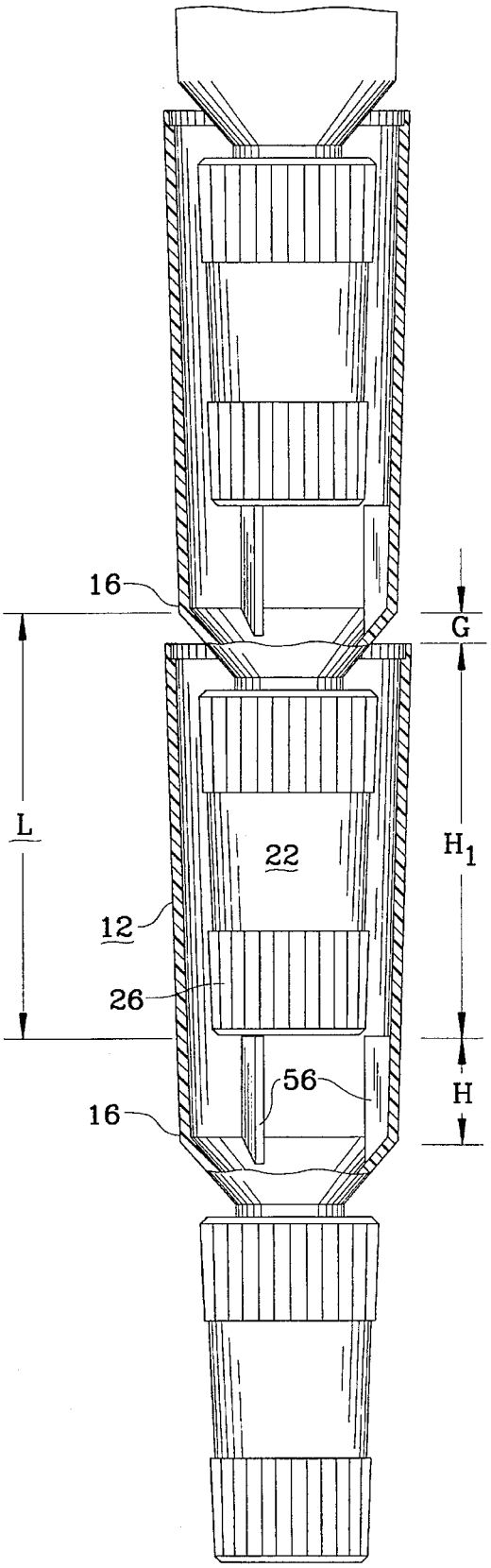
FIG. 5 is a side elevational view partly in section showing a series of unit dose assemblies in a nested position, in a cap down orientation the attitude in which they would be fed into automatic feeding system for filling and sealing.

Considering briefly handling of cap and tube assemblies in automated filling and sealing systems, caps and tubes are assembled to one another in the relationship shown in FIG. 3 and thereafter placed in random array in a hopper having means for orienting the assemblies cap (22) down to an infeed station where the assemblies nest and align in the manner shown in FIG. 5. The infeed assembly may include an elongated vertical chute where the assemblies are oriented one on top of the other in the manner shown in FIG. 5. The system further includes means for removing the lower most cap and tube assembly from the infeed station and delivering it to a feeding station where the tube is filled and thereafter to a heat sealing station where the lower edge of the tube is sealed. The filled assemblies are then moved to a discharge station for packaging and shipping.

As noted above, trouble free feeding of the assemblies is particularly important to minimize down time of the automated filling and sealing system described. It has been found that if there is a gap G of predetermined dimension between the lower axial end (53) of the open tube (12) and the next adjacent nested tube, triggering or finger mechanism for discharging tubes one at a time from the infeed chute can operate most effectively to insure discharge of one assembly at a time to the filling and sealing stations. To this end in accordance with the present invention, each tube is provided with a series circumferentially spaced ribs (56) on the interior of the tube adjacent the transition wall (16) which project radially inwardly a sufficient distance to space the adjacent assemblies in a manner to define the gap G. Thus the diameter D defined by the inner trace of the ribs (56) is smaller than the diameter $D_2$ of the piercing portion (26) so that the parts assume the relationship shown in FIG. 5. Further, the diameter D is preferably greater than the diameter $D_3$ of the entrance end of the nozzle portion of the tube. Further, the axial height H of the ribs (56) extends downwardly from the transition shoulder (16) to a point where the distance $H_1$ from the lower edge of the ribs to the open end of the tube is less than distance L from the shoulder (16) of the next adjacent nested assembly. This defines the desired gap G between nested assemblies.

Even though particular embodiments of the present invention have been illustrated and described herein, it is not intended to limit the invention and changes and modifications may be made therein within the scope of the following claims.

What is claimed is:

1. A container and closure assembly comprising a container having a body portion and a nozzle at one end of the body portion and having a reduced cross-section and a transition shoulder connecting the nozzle and body portion, a closure cap engagable over the nozzle portion, at least one internal rib in the container adjacent the juncture of the body portion and nozzle extending downwardly into the body portion a predetermined depth wherein when a plurality of said container and closure cap assemblies are nested, and the closure cap of a second said container and closure cap assembly engages interiorly the body portion of a first adjacent said container and cap assembly to a point where the second said container and closure cap assembly abuts the ribs of the first container and cap assembly, the length (L) between an upper portion of the container cap and transition shoulder of said second container and cap assembly is greater than the distance ($H_1$) from the lower most edge of said internal rib and the lower most terminal edge of the body portion of the container of said first container and cap assembly.

2. The combination as claimed in claim 1 wherein said at least one internal rib comprises a plurality of circumferentially spaced ribs.

3. The combination as claimed in claim 1 wherein the closure cap and nozzle of said container and closure cap assembly have interengaging rib means for detachably mounting the cap on the nozzle portion.

4. The combination as claimed in claim 1 wherein said closure cap has a transverse wall dividing the closure cap into a piercing portion and a sealing portion.

5. The combination as claimed in claim 4 including a piercing element projecting from said wall.

* * * * *